US011039968B2

(12) United States Patent
Choi

(10) Patent No.: US 11,039,968 B2
(45) Date of Patent: Jun. 22, 2021

(54) MOTORIZED BED AND BED FRAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 15 days.

(21) Appl. No.: 16/382,029

(22) Filed: Apr. 11, 2019

(65) Prior Publication Data

US 2019/0328593 A1 Oct. 31, 2019

(30) Foreign Application Priority Data

Apr. 27, 2018 (CN) ..... 201820618978.8

(51) Int. Cl.

| | |
|---|---|
| ***A61G 7/015*** | (2006.01) |
| ***A47C 19/12*** | (2006.01) |
| ***A61G 7/018*** | (2006.01) |
| ***A47C 20/04*** | (2006.01) |
| ***A47C 19/02*** | (2006.01) |

(52) U.S. Cl.

CPC ..... *A61G 7/015* (2013.01); *A47C 19/122* (2013.01); *A61G 7/018* (2013.01); *A47C 19/021* (2013.01); *A47C 20/041* (2013.01)

(58) Field of Classification Search

CPC ..... A61G 7/015; A61G 7/018; A61G 7/002; A61G 7/012; A61G 7/005; A61G 13/08; A47C 20/04; A47C 20/041; A47C 20/08; A47C 20/10; A47C 20/12; A47C 20/18; A47C 19/021; A47C 19/122

See application file for complete search history.

(56) References Cited

U.S. PATENT DOCUMENTS

| | | | | |
|---|---|---|---|---|
| 2005/0000020 | A1* | 1/2005 | Schermel | A47C 20/04 5/618 |
| 2012/0240337 | A1* | 9/2012 | Shih | A47C 20/041 5/616 |
| 2013/0318720 | A1 | 12/2013 | Connell | |
| 2014/0215717 | A1* | 8/2014 | Rigsby | A61G 7/05 5/613 |
| 2014/0250599 | A1* | 9/2014 | Cassell | A61G 7/015 5/613 |
| 2016/0120327 | A1* | 5/2016 | Shimada | A47C 19/12 5/11 |
| 2016/0286970 | A1* | 10/2016 | Robertson | A47C 20/08 |
| 2017/0087039 | A1* | 3/2017 | Shih | A61G 7/018 |
| 2017/0354265 | A1* | 12/2017 | Kramer | A47C 19/025 |
| 2019/0223609 | A1* | 7/2019 | Sherman | A47C 27/14 |
| 2019/0298074 | A1* | 10/2019 | Dan-On | A61G 7/018 |

* cited by examiner

*Primary Examiner* — Nicholas F Polito
*Assistant Examiner* — George Sun
(74) *Attorney, Agent, or Firm* — Morgan, Lewis & Bockius LLP

(57) ABSTRACT

Disclosed are motorized beds and bed frames. A motorized bed frame includes a lower frame and an upper frame disposed above the lower frame. At one or each of first and second sides of the motorized bed frame, the motorized bed frame also includes an actuating unit and a gearing unit to move and position an upper sub-frame of the upper frame with respective to the lower frame. The upper sub-frames at the first and sides can be independently positioned to meet individual needs. In some cases, the motorized bed frame includes additional or optional components to help dispersing the load and stabilizing the bed frame during operation.

19 Claims, 2 Drawing Sheets

MOTORIZED BED AND BED FRAME

CROSS-REFERENCE TO RELATED APPLICATIONS

The present application claims priority to Chinese Utility Model Application CN 201820618978.8 filed Apr. 27, 2018. The disclosure of the application is incorporated herein for all purposes by reference in its entirety.

FIELD OF THE INVENTION

The present invention generally relates to beds and bed frames, and more particularly, to motorized beds and motorized bed frames.

BACKGROUND

Motorized beds become more and more popular because they do not require manual operation and are convenient to use. However, existing motorized beds have some issues that need to be addressed. For instance, some motorized beds are configured such that only a portion of the upper frame can be moved and repositioned, or different portions of the upper frame have to be moved and repositioned concurrently. As such, existing motorized beds may not be able to meet individual's needs since each individual generally has his/her own preference regarding the comfort.

Moreover, most of existing motorized beds do not have sufficient support for upper frames. As such, upper frames may vibrate during repositioning or when in use. Further, some existing motorized beds may experience unbalanced loads, e.g., having a large force or torque exerting on one or a few components. This could damage the component(s) and make the motorized beds unsafe to use.

Given the current state of the art, there remains a need for motorized beds and bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides motorized bed frames and beds having such motorized bed frames.

In various embodiments, a motorized bed frame includes a lower frame and an upper frame disposed above the lower frame. The lower frame extends from a first side of the motorized bed frame to a second side of the motorized bed frame. At each of the first and second sides of the motorized bed frame, the motorized bed frame further includes an actuating unit and a gearing unit. The actuating unit is disposed at the lower frame and includes an adjustable column. The gearing unit is connected with the upper frame and the adjustable column of the actuating unit.

In some embodiments, the lower frame includes a first longitudinal bar, a second longitudinal bar, a first lateral bar and a second lateral bar. The first and second longitudinal bars are substantially parallel to each other, and each of the first lateral bars has a first end connected to the first longitudinal bar and a second end connected to the second longitudinal bar.

In some embodiments, at each of the first and second sides of the motorized bed frame, the upper frame includes an upper sub-frame movable with respect to the lower frame. The upper sub-frame at the first side of the motorized bed frame is directly or indirectly connected with the upper sub-frame at the second side of the motorized bed frame.

In many embodiments, the lower frame includes a first longitudinal bar and a second longitudinal bar substantially parallel to each other. At each of the first and second sides of the motorized bed frame, the upper frame includes an upper sub-frame movable with respect to the lower frame. The upper sub-frame at the first side of the motorized bed frame is directly or indirectly connected with the upper sub-frame at the second side of the motorized bed frame. At each of the first and second sides of the motorized bed frame, the gearing unit includes a first gearing piece, one or more second gearing pieces, and one or more third gearing pieces. The first gearing piece has a first end rotatably connected with the first longitudinal bar and a second end rotatably connected with the second longitudinal bar of the lower frame. Each of the one or more second gearing pieces has a first end fixedly connected with the first gearing piece and a second end pivotally connected with the upper sub-frame. Each of the one or more third gearing pieces has a first end fixedly connected with the first gearing piece and a second end pivotally connected with the adjustable column of the actuating unit. When operated, the adjustable column pulls/pushes the one or more third gearing pieces, which in turn rotate the first gearing piece with respect to the lower frame. The one or more second gearing pieces rotate along with the first gearing piece, thereby pulling/pushing the upper sub-frame and consequently positioning the upper sub-frame at different positions with respect to the lower frame.

In some embodiments, at one or each of the first and second sides of the motorized bed frame, the lower frame further includes a fixation bar, and the motorized bed frame further includes one or more fixation-gearing-linking pieces. The fixation bar has a first end fixedly connected with the first longitudinal bar and a second end fixedly connected with the second longitudinal bar of the lower frame. Each of the one or more fixation-gearing-linking pieces has a first end fixedly connected with the fixation bar of the lower frame and a second end rotatably connected with the first gearing piece of the gearing unit.

In an exemplary embodiment, a respective fixation-gearing-linking piece in the one or more fixation-gearing-linking pieces is of an "U" shape with an open end portion and a closed end portion. The open end portion of the "U"-shaped fixation-gearing-linking piece is fixedly connected with the fixation bar of the lower frame. Crosswise, the first gearing piece of the gearing unit is disposed inside the "U"-shaped fixation-gearing-linking piece and adjacent the closed end portion of the "U"-shaped fixation-gearing-linking piece. The first gearing piece of the gearing unit is rotatable with respect to the "U"-shaped fixation-gearing-linking piece.

In some embodiments, at one or each of the first and second sides of the motorized bed frame, the gearing unit further include a gearing-piece-linking bar disposed between two second gearing pieces and having two ends each fixedly connected with one of the two second gearing pieces. In an exemplary embodiment, the corresponding first or second lateral bar includes a lateral groove to accommodate at least a portion of the gearing-piece-linking bar when the upper sub-frame is laid on the lower frame.

In some embodiments, the motorized bed frame further includes a movable bar at one or each of the first and second sides of the motorized bed frame. The movable bar has a first end pivotally connected with one of the first and second longitudinal bars and a second end pivotal connected with the upper frame. In an embodiment, the one longitudinal bar includes a longitudinal groove to accommodate at least a portion of the movable bar when the upper frame is laid on the lower frame.

In various embodiments, a motorized bed frame includes a lower frame extending from a first side of the motorized bed frame to a second side of the motorized bed frame. The motorized bed frame also includes an upper frame disposed above the lower frame. At one or each of the first and second sides of the motorized bed frame, the upper frame includes an upper sub-frame that is movable with respect to the lower frame. At the one or each of the first and second sides of the motorized bed frame, the motorized bed frame further includes an actuating unit and a gearing unit. The actuating unit is disposed at the lower frame and includes an adjustable column. The gearing unit includes a first gearing piece, one or more second gearing pieces, and one or more third gearing pieces. The first gearing piece is rotatably connected with the lower frame. Each of the one or more second gearing pieces has a first end fixedly connected with the first gearing piece and a second end pivotally connected with the upper sub-frame. Each of the one or more third gearing pieces has a first end fixedly connected with the first gearing piece and a second end pivotally connected with the adjustable column of the actuating unit. When operated, the adjustable column pulls/pushes the one or more third gearing pieces, which in turn rotate the first gearing piece with respect to the lower frame. The one or more second gearing pieces rotate along with the first gearing piece, thereby pulling/pushing the upper sub-frame and consequently positioning the upper sub-frame at different positions with respect to the lower frame.

In some embodiments, the upper sub-frames at the first and second sides of the motorized bed frame are directly or indirectly connected with each other, and are independently movable with respect to the lower frame.

In an embodiment, the upper sub-frame at the first or second side of the motorized bed frame includes two or more sub-frames pivotally connected to each other.

In many embodiments, the lower frame includes a first longitudinal bar and a second longitudinal bar, a first lateral bar and a second lateral bar. The first and second longitudinal bars are substantially parallel to each other, and each of the first lateral bars has a first end connected to the first longitudinal bar and a second end connected to the second longitudinal bar. At the one or each of the first and second sides of the motorized bed frame, the gearing unit further include a gearing-piece-linking bar disposed between two second gearing pieces and having two ends each fixedly connected with one of the two second gearing pieces.

In an embodiment, at the one or each of the first and second sides of the motorized bed frame, the corresponding first or second lateral bar includes a lateral groove to accommodate at least a portion of the gearing-piece-linking bar when the upper sub-frame is laid on the lower frame.

In some embodiments, the motorized bed frame further includes one or more movable bars at the one or each of the first and second sides of the motorized bed frame. A respective movable bar in the one or more movable bars has a first end pivotally connected with a corresponding longitudinal bar in the first and second longitudinal bars, and a second end pivotal connected with the upper frame.

In an embodiment, at the one or each of the first and second sides of the motorized bed frame, the corresponding longitudinal bar includes a longitudinal groove to accommodate at least a portion of the respective movable bar when the upper frame is laid on the lower frame.

In many embodiments, the lower frame includes a first longitudinal bar and a second longitudinal bar substantially parallel to each other. At the one or each of the first and second sides of the motorized bed frame, the first gearing piece of the gearing unit has a first end rotatably connected with the first longitudinal bar and a second end rotatably connected with the second longitudinal bar of the lower frame.

In some embodiments, the motorized bed frame further includes one or more movable bars at the one or each of the first and second sides of the motorized bed frame. A respective movable bar in the one or more movable bars has a first end pivotally connected with a corresponding longitudinal bar in the first and second longitudinal bars, and a second end pivotal connected with the upper frame. The corresponding longitudinal bar includes a longitudinal groove to accommodate at least a portion of the respective movable bar when the upper frame is laid on the lower frame.

In some embodiments, at the one or each of the first and second sides of the motorized bed frame, the lower frame further includes a fixation bar and the motorized bed frame further includes one or more fixation-gearing-linking pieces. The fixation bar has a first end fixedly connected with the first longitudinal bar and a second end fixedly connected with the second longitudinal bar of the lower frame. Each of the one or more fixation-gearing-linking pieces has a first end fixedly connected with the fixation bar of the lower frame and a second end rotatably connected with the first gearing piece of the gearing unit.

In an embodiment, a respective fixation-gearing-linking piece in the one or more fixation-gearing-linking pieces is of an "U" shape with an open end portion and a closed end portion. The open end portion of the "U"-shaped fixation-gearing-linking piece is fixedly connected with the fixation bar of the lower frame. Crosswise, the first gearing piece of the gearing unit is disposed inside the "U"-shaped fixation-gearing-linking piece and adjacent the closed end portion of the "U"-shaped fixation-gearing-linking piece. The first gearing piece of the gearing unit is rotatable with respect to the "U"-shaped fixation-gearing-linking piece.

The beds and bed frames of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

Figure 1:
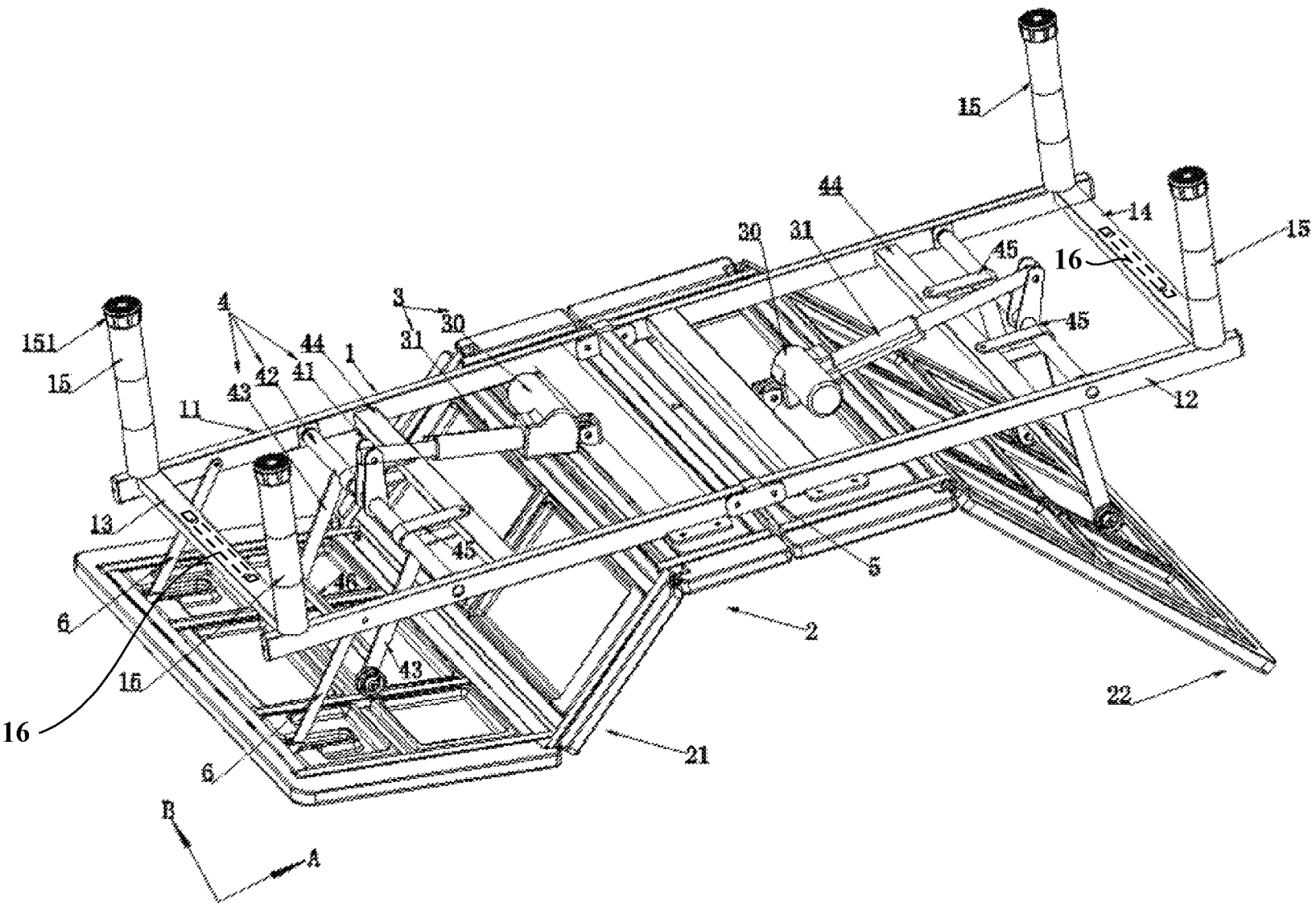
FIG. 1 is an upside-down perspective view illustrating an exemplary bed frame in accordance with exemplary embodiments of the present invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only.

Embodiments of the present invention are described in the context of motorized beds and motorized bed frames. In general, a motorized bed includes one or more motorized bed frames. In many cases, a motorized bed frame of the present invention includes a lower frame and an upper frame disposed above the lower frame. When laid out or in use, the lower frame extends from a first side of the motorized bed frame to a second side of the motorized bed frame (e.g., head to foot, or foot to head). In some cases, the lower frame includes a supporting frame extending from the first side of the motorized bed frame to the second side of the motorized bed frame.

The upper frame includes one or more upper sub-frames each movable with respect to the lower frame. The motorized bed frame of the present invention also includes one or more actuating units and one or more gearing units for moving and positioning the one or more upper sub-frames. The one or more actuating units are disposed at the lower frame in accordance with the one or more upper sub-frames. The one or more gearing units are connected with the one or more actuating units and with the one or more upper sub-frames. As such, via the one or more gearing units, the one or more upper sub-frames can be positioned (e.g., tilted, lifted, lowered) at any suitable positions to user's preferences by operating the one or more actuating units.

The motorized beds and bed frames of the present invention can be of various sizes including but not limited to twin, full, queen and king sizes, and of various shapes including but not limited to rectangles and squares. They can be made of various materials including but not limited to metals such as steel, plastics and woods.

Figure 2:
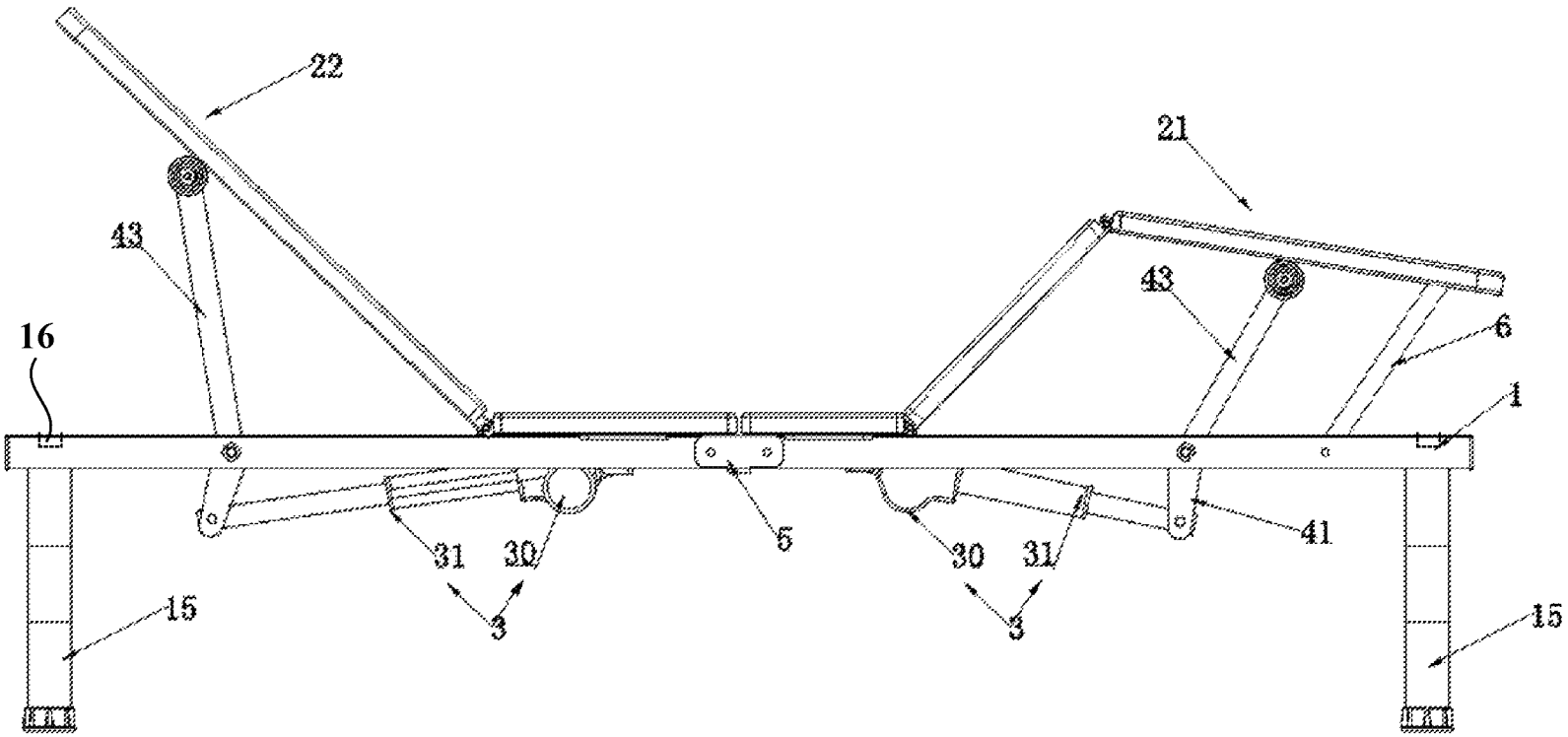
FIG. 2 is a side view illustrating the exemplary bed frame of FIG. 1 in accordance with exemplary embodiments of the present invention.

Referring now to FIGS. 1 and 2, in some embodiments, a motorized bed frame of the present invention includes lower frame 1, upper frame 2, actuating unit 3 and gearing unit 4. When in use, lower frame 1 generally extends from a first side of the motorized bed frame to a second side of the motorized bed frame (e.g., left and right sides in FIG. 1, where longitudinal and lateral directions are indicated by arrows A and B). In some embodiments, lower frame 1 includes first longitudinal bar 11 and second longitudinal bar 12 disposed substantially parallel to each other and extending from the first side of the motorized bed frame to the second side of the motorized bed frame. Each of the first and second longitudinal bars can be in one piece or made of two or more bar segments pivotally-connected.

In some embodiments, the lower frame further includes one or more lateral bars disposed in between the first and second longitudinal bars. The one or more lateral bars can be disposed at any suitable positions along the first and second longitudinal bars. By way of example, FIG. 1 illustrates first lateral bar 13 and second later 14 disposed respectively at the first and second sides of the motorized bed frame, and adjacent end portions of the first and second longitudinal bars. Each lateral bar has a first end connected to the first longitudinal bar and a second end connected to the second longitudinal bar.

In some embodiments, lower frame 1 also includes a plurality of legs such as legs 15 disposed below, and connected with the first or second longitudinal bar or with the first or second lateral bar. In an embodiment, leg 15 has an anti-slip base such as anti-slip base 151 at its lower end to help stabilize the motorized bed frame.

In some embodiments, lower frame 1 further includes one or more fixation bars fixedly coupled with the supporting frame. For instance, by way of example, FIG. 1 illustrates fixation bar 44 having one end fixedly connected with the first longitudinal bar and the other end fixedly connected with the second longitudinal bar.

Upper frame 2 includes one or more upper sub-frames that are movable with respect to the supporting frame of the lower frame. In an embodiment, there is only one movable upper sub-frame. In another embodiment, there are two movable upper sub-frames, with one disposed at each of the first and second sides of the motorized bed frame. In yet another embodiment, there are more than two movable upper sub-frames. In exemplary embodiments where there are more than one movable upper sub-frames, any two movable upper sub-frames can be directly connected with each other (e.g., disposed adjacent each other) or indirectly connected with each other (e.g., via one or more intermediate sub-frames which can be stationary or movable). Each of the one or more upper sub-frames is movable with respect to the supporting frame of the lower frame. In some cases, two or more upper sub-frames are independently movable from each other with respect to the supporting frame of the lower frame. In some cases, two or more upper sub-frames are pivotally connected with each other.

By way of example, FIG. 1 illustrates two movable upper sub-frames, in which first upper sub-frame 21 is disposed at the first side of the motorized bed frame and second upper sub-frame 22 at the second side of the motorized bed frame. The first and second upper sub-frames are connected to each other via two intermediate sub-frames which are connected to each other by connector 5. The two intermediate sub-frames can be stationary or movable with respect to each other. In some cases, the two intermediate sub-frames are also connected to the lower frame by connector 5 and/or other connectors, and can be stationary or movable with respect to the lower frame. In some embodiments, one or each of the first and second upper sub-frames itself can include two or more sub-frames that are connected or pivotally connected to each other. As an example, FIG. 1 illustrates first upper sub-frame 21 includes two pivotally-connected sub-frames.

Actuating unit 3 is disposed at the lower frame to provide force or power for moving and positioning the one or more upper sub-frames. By way of example, FIG. 1 illustrates one actuating unit disposed at the first side of the motorized bed frame to move the first upper sub-frame and one actuating unit disposed at the second side of the motorized bed frame to move the second upper sub-frame. The actuating units at the first and second sides of the motorized bed frame can be operated concurrently with each other or independently from each other. As such, using the actuating units (along with the gearing unit), one can position the first and second upper sub-frames separately at any suitable positions in accordance with his/her own preference.

In some embodiments, actuating unit 3 includes an adjustable column, such as adjustable column 31, that can be extended and retracted. In some embodiments, actuating unit 3 also includes a driving component (e.g., motor), such as driving component 30, to drive the adjustable column. In an embodiment, the driving component is movably (e.g., pivotally) connected with the lower frame to allow the driving component to rotate during the operation.

Gearing unit 4 transfers the linear motion of the adjustable column to the one or more upper sub-frames. By way of example, FIG. 1 illustrates one gear unit disposed at each of the first and second sides of the motorized bed frame. In some embodiments, gear unit 4 includes a first gearing piece, such as first gearing piece 42, rotatably connected with the lower frame. For instance, in an embodiment, first gearing piece 42 has one end rotatably connected with first longitudinal bar 11 and the other end rotatably connected with second longitudinal bar 12.

Gear unit 4 also includes one or more second gearing pieces, such as second gearing piece 43, each having a first end fixedly connected with the first gearing piece and a second end pivotally connected with the upper sub-frame at the corresponding first or second side of the motorized bed frame. Gear unit 4 further includes one or more third gearing pieces, such as third gearing piece 41, each having a first end fixedly connected with the first gearing piece and a second end pivotally connected with the adjustable column of the actuating unit at the corresponding first or second side of the motorized bed frame. In an embodiment such as that illustrated in FIG. 1, gear unit 4 includes two second gearing pieces 43 and two third gearing pieces 41, in which one third gearing piece is disposed on each side of the adjustable column of the actuating unit.

During an operation, adjustable column 31, driven by driving component 30, contracts or extends, thereby pulling or pushing third gearing pieces 41. Third gearing pieces 41 in turn rotate first gearing piece 42 with respect to the supporting frame of the lower frame. Second gearing pieces 43 rotate along with first gearing piece 42, thereby pulling or pushing the corresponding upper sub-frame and consequently positioning the upper sub-frame at different positions (e.g., at different angles, elevated or folded) with respect to the supporting frame of the lower frame.

In some embodiments, corresponding to a gearing unit, the motorized bed frame further includes one or more fixation-gearing-linking pieces, such as fixation-gearing-linking piece 45, configured to connect the gearing unit with the fixation bar of the lower frame. The fixation bar of the lower frame can be positioned in an interior or exterior side of the lower frame with respect to the first gearing piece of the gearing unit. As an example, FIG. 1 illustrates fixation bar 44 disposed in the interior side of the lower frame with respect to first gearing piece 42 of the gearing unit.

In some embodiments, the fixation-gearing-linking piece has a first end fixedly connected with the fixation bar of the lower frame and a second end rotatably connected with the first gearing piece of the gearing unit. The fixation-gearing-linking piece and the fixation bar of the lower frame help to stabilize the first gearing piece of the gearing unit and disperse the load (e.g., force or torque) across different components. As a result, they help to reduce or eliminate the vibration of the first gearing piece of the gearing unit, and reduce friction wearing at the first and second longitudinal bars and reducing vibration. Consequently, they make the motorized bed frame more stable and more durable.

In some embodiments, the fixation-gearing-linking piece is configured with an open end portion such as open end portion 451 and a closed end portion such as closed end portion 452. The open end portion is fixedly connected with the fixation bar of the lower frame, and the closed end portion is rotatably connected with the first gearing piece of the gearing unit. For instance, in an embodiment, the fixation-gearing-linking piece is of an "U" shape. The open end portion of the "U"-shaped fixation-gearing-linking piece is fixedly connected with the fixation bar of the lower frame. Crosswise, the first gearing piece of the gearing unit is disposed inside the "U"-shaped fixation-gearing-linking piece and adjacent the closed end portion of the "U"-shaped fixation-gearing-linking piece. The first gearing piece of the gearing unit and the "U"-shaped fixation-gearing-linking piece are configured such that the first gearing piece is rotatable with respect to the "U"-shaped fixation-gearing-linking piece.

The fixation-gearing-linking piece can be made of any suitable materials. In an embodiment, the fixation-gearing-linking piece is made of a metal or a metallic material.

In some embodiments, at one or each of the first and second sides of the motorized bed frame, the gearing unit further includes a gearing-piece-linking bar, such as gearing-piece-linking bar 46, to reinforce the gearing unit and to help dispersing the load exerted on the gearing unit. For instance, in an embodiment, gearing-piece-linking bar 46 is disposed between two second gearing pieces 43 and having two ends each fixedly connected with one of the two second gearing pieces. The corresponding lateral bar, e.g. first lateral bar 13 or second lateral bar 14, includes a lateral groove such as lateral groove 16 configured to accommodate at least a portion of the gearing-piece-linking bar when the upper sub-frame is laid on the lower frame. This helps to disperse the load on the gearing unit, and thus prolongs the lifetime of the gearing unit. This also helps to stabilize the upper frame and make it less likely to vibrate.

In some embodiments, the motorized bed frame includes some other additional, optional or alternative components. For instance, the motorized bed frame can include one or more movable bars to further disperse the load and/or to further assist in stabilizing the bed frame. The one or more movable bars can be disposed at the first and/or second sides and connected with the lower and upper frames. By way of example, FIG. 1 illustrates two movable bars 6 disposed at the first side of the motorized bed frame. Movable bar 6 has one end pivotally connected with the lower frame, e.g., longitudinal bar 11 or 12 of the lower frame, and another end pivotally connected with first upper sub-frame 21. In some embodiments, the corresponding longitudinal bar includes a longitudinal groove configured to accommodate a portion of the movable bar or the entire movable bar when the upper sub-frame is laid on the lower frame.

Movable bar 6 reduces the load exerted on the gearing unit, in particular, on first gearing piece 42 and second gearing piece 43 of the gearing unit. As such, movable bar 6 helps to reduce/eliminate the deformation/vibration of the first gearing piece of the gearing unit and accordingly reduce/eliminate the vibration of the motorized bed frame. In addition, in embodiments where the upper sub-frame itself includes two or more sub-frames such as those illustrated in FIG. 1, the gearing unit and the movable bar can be used to position the two or more sub-frames in different positions.

The present invention has several advantages. For instance, the motorized beds and bed frames of the present invention allow independent positioning of different upper sub-frames to meet individual's preference and satisfy individual's needs. Also, the motorized beds and bed frames of the present invention include fixation bar(s), fixation-gearing-linking piece(s), gearing-piece-linking bar(s), movable bar(s), or any combination thereof, to help dispersing the load (e.g., force or torque) across the bed frames, thereby reducing/eliminating deformation/vibration of the gearing unit and adverse effects due to the deformation/vibration of the gearing unit. Operation of the motorized beds and bed frames of the present invention is smoother with less vibration. As a result, the motorized beds and bed frames of the present invention are more stable and more durable.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first side could be termed a second side, and, similarly, a second side could be termed a first side, without changing the meaning of the description, so long as all occurrences of the "first side" are renamed consistently and all occurrences of the "second side" are renamed consistently.

What is claimed is:

1. A motorized bed frame comprising:

a lower frame extending from a first side of the motorized bed frame to a second side of the motorized bed frame in a longitudinal direction of the motorized bed frame, wherein the lower frame comprises a first longitudinal bar and a second longitudinal bar substantially parallel to each other;

an upper frame disposed above the lower frame, wherein at each of the first and second sides of the motorized bed frame, the upper frame comprises an upper sub-frame movable with respect to the lower frame, wherein the upper sub-frame at the first side of the motorized bed frame is directly or indirectly connected with the upper sub-frame at the second side of the motorized bed frame; and at each of the first and second sides of the motorized bed frame, the motorized bed frame further comprising:

an actuating unit disposed at the lower frame and comprising an adjustable column; and a gearing unit connected with the upper frame and the adjustable column of the actuating unit, wherein the gearing unit comprises:

a first gearing piece having a first end rotatably connected with the first longitudinal bar and a second end rotatably connected with the second longitudinal bar of the lower frame;

one or more second gearing pieces, each having a first end fixedly connected with the first gearing piece and a second end pivotally connected with the upper sub-frame; and one or more third gearing pieces, each having a first end fixedly connected with the first gearing piece and a second end pivotally connected with the adjustable column of the actuating unit;

wherein when operated, the adjustable column pulls/pushes the one or more third gearing pieces which in turn rotate the first gearing piece with respect to the lower frame, the one or more second gearing pieces rotate along with the first gearing piece, thereby pulling/pushing the upper sub-frame and consequently positioning the upper sub-frame at different positions with respect to the lower frame;

wherein:

the lower frame further comprises a first inner lateral bar at the first side of the motorized bed frame and a second inner lateral bar at the second side of the motorized bed frame, each having a first end connected with the first longitudinal bar and a second end connected with the second longitudinal bar of the lower frame;

the adjustable column of the actuating unit at the first side of the motorized bed frame has a first end connected with the first inner lateral bar of the lower frame at the first side of the motorized bed frame and a second end connected with the first gearing piece by the one or more third gearing pieces of the gearing unit at the first side of the motorized bed frame;

the adjustable column of the actuating unit at the second side of the motorized bed frame has a first end connected with the second inner lateral bar of the lower frame at the second side of the motorized bed frame and a second end connected with the first gearing piece by the one or more third gearing pieces of the gearing unit at the second side of the motorized bed frame; and the adjustable column of the actuating unit at the first side of the motorized bed frame is spaced apart from the adjustable column of the actuating unit at the second side of the motorized bed frame in the longitudinal direction of the motorized bed frame.

2. The motorized bed frame of claim 1, wherein the lower frame further comprises a first lateral bar and a second lateral bar, wherein each of the first lateral bars has a first end connected to the first longitudinal bar and a second end connected to the second longitudinal bar.

3. The motorized bed frame of claim 2, wherein at one or each of the first and second sides of the motorized bed frame:

the gearing unit further comprises a gearing-piece-linking bar disposed between two second gearing pieces and having two ends each fixedly connected with one of the two second gearing pieces; and the corresponding first or second lateral bar comprises a lateral groove to accommodate at least a portion of the gearing-piece-linking bar when the upper sub-frame is laid on the lower frame.

4. The motorized bed frame of claim 1, wherein at each of the first and second sides of the motorized bed frame, the upper frame comprises an upper sub-frame movable with respect to the lower frame, wherein the upper sub-frame at the first side of the motorized bed frame is directly or indirectly connected with the upper sub-frame at the second side of the motorized bed frame.

5. The motorized bed frame of claim 1, wherein at one or each of the first and second sides of the motorized bed frame:

the lower frame further comprises a fixation bar, wherein the fixation bar has a first end fixedly connected with the first longitudinal bar and a second end fixedly connected with the second longitudinal bar of the lower frame; and the motorized bed frame further comprises one or more fixation-gearing-linking pieces, each having a first end fixedly connected with the fixation bar of the lower frame and a second end rotatably connected with the first gearing piece of the gearing unit.

6. The motorized bed frame of claim 5, wherein a respective fixation-gearing-linking piece in the one or more fixation-gearing-linking pieces is of an "U" shape with an open end portion and a closed end portion, wherein the open end portion of the "U"-shaped fixation-gearing-linking piece is fixedly connected with the fixation bar of the lower frame, and wherein crosswise, the first gearing piece of the gearing unit is disposed inside the "U"-shaped fixation-gearing-linking piece and adjacent the closed end portion of the "U"-shaped fixation-gearing-linking piece, wherein the first gearing piece of the gearing unit is rotatable with respect to the "U"-shaped fixation-gearing-linking piece.

7. The motorized bed frame of claim 1, further comprising:

a movable bar at one or each of the first and second sides of the motorized bed frame, the movable bar having a first end pivotally connected with one of the first and second longitudinal bars and a second end pivotal connected with the upper frame.

8. The motorized bed frame of claim 1, wherein the upper sub-frames at the first and second sides of the motorized bed frame are directly or indirectly connected with each other, and are independently movable with respect to the lower frame.

9. The motorized bed frame of claim 1, wherein the upper sub-frame at the first or second side of the motorized bed frame comprises two or more sub-frames pivotally connected to each other.

10. A motorized bed frame comprising:

a lower frame extending from a first side of the motorized bed frame to a second side of the motorized bed frame;

an upper frame disposed above the lower frame and comprising an upper sub-frame at one or each of the first and second sides of the motorized bed frame, wherein the upper sub-frame is movable with respect to the lower frame; and at the one or each of the first and second sides of the motorized bed frame, the motorized bed frame further comprising:

an actuating unit disposed at the lower frame and comprising an adjustable column; and a gearing unit comprising:

a first gearing piece rotatably connected with the lower frame;

one or more second gearing pieces, each having a first end fixedly connected with the first gearing piece and a second end pivotally connected with the upper sub-frame; and one or more third gearing pieces, each having a first end fixedly connected with the first gearing piece and a second end pivotally connected with the adjustable column of the actuating unit;

wherein when operated, the adjustable column pulls/pushes the one or more third gearing pieces which in turn rotate the first gearing piece with respect to the lower frame, the one or more second gearing pieces rotate along with the first gearing piece, thereby pulling/pushing the upper sub-frame and consequently positioning the upper sub-frame at different positions with respect to the lower frame;

wherein:

the lower frame comprises a first longitudinal bar and a second longitudinal bar, a first lateral bar and a second lateral bar, wherein the first and second longitudinal bars are substantially parallel to each other, and each of the first lateral bars has a first end connected to the first longitudinal bar and a second end connected to the second longitudinal bar;

at the one or each of the first and second sides of the motorized bed frame:

the gearing unit further comprises a gearing-piece-linking bar disposed between two second gearing pieces and having two ends each fixedly connected with one of the two second gearing pieces; and at the one or each of the first and second sides of the motorized bed frame, the corresponding first or second lateral bar comprises a lateral groove to accommodate at least a portion of the gearing-piece-linking bar when the upper sub-frame is laid on the lower frame.

11. The motorized bed frame of claim 10, further comprising:

one or more movable bars at the one or each of the first and second sides of the motorized bed frame, each of the one or more movable bars having a first end pivotally connected with a corresponding longitudinal bar in the first and second longitudinal bars, and a second end pivotally connected with the upper frame.

12. The motorized bed frame of claim 1, wherein the first inner lateral bar of the lower frame, the second inner lateral bar of the lower frame, the first gearing piece of the gearing unit at the first side of the motorized bed frame, and the first gearing piece of the gearing unit at the second side of the motorized bed frame are disposed in a plane defined by the first and second longitudinal bars of the lower frame.

13. The motorized bed frame of claim 1, wherein each of the first and second longitudinal bars comprises a first bar segment at the first side of the motorized bed frame and a second bar segment at the second side of the motorized bed frame pivotally connected with each other.

14. The motorized bed frame of claim 1, wherein the actuating unit and the gearing unit at the first side of the motorized bed frame are spaced apart from the actuating unit and the gearing unit at the second side of the motorized bed frame in the longitudinal direction of the motorized bed frame.

15. A motorized bed frame comprising:

a lower frame extending from a first side of the motorized bed frame to a second side of the motorized bed frame, wherein the lower frame comprises a first longitudinal bar and a second longitudinal bar substantially parallel to each other;

an upper frame disposed above the lower frame and comprising an upper sub-frame at one or each of the first and second sides of the motorized bed frame, wherein the upper sub-frame is movable with respect to the lower frame; and at the one or each of the first and second sides of the motorized bed frame, the motorized bed frame further comprising:

an actuating unit disposed at the lower frame and comprising an adjustable column; and a gearing unit comprising:

a first gearing piece rotatably having a first end rotatably connected with the first longitudinal bar and a second end rotatably connected with the second longitudinal bar of the lower frame;

one or more second gearing pieces, each having a first end fixedly connected with the first gearing piece and a second end pivotally connected with the upper sub-frame; and one or more third gearing pieces, each having a first end fixedly connected with the first gearing piece and a second end pivotally connected with the adjustable column of the actuating unit;

wherein when operated, the adjustable column pulls/pushes the one or more third gearing pieces which in turn rotate the first gearing piece with respect to the lower frame, the one or more second gearing pieces rotate along with the first gearing piece, thereby pulling/pushing the upper sub-frame and consequently positioning the upper sub-frame at different positions with respect to the lower frame;

wherein at the one or each of the first and second sides of the motorized bed frame:

the lower frame further comprises a fixation bar having a first end fixedly connected with the first longitudinal bar and a second end fixedly connected with the second longitudinal bar of the lower frame; and the motorized bed frame further comprises one or more fixation-gearing-linking pieces, each having a first end fixedly connected with the fixation bar of the lower frame and a second end rotatably connected with the first gearing piece of the gearing unit;

wherein a respective fixation-gearing-linking piece in the one or more fixation-gearing-linking pieces is of an "U" shape with an open end portion and a closed end portion, wherein the open end portion of the "U"-shaped fixation-gearing-linking piece is fixedly connected with the fixation bar of the lower frame, and wherein crosswise, the first gearing piece of the gearing unit is disposed inside the "U"-shaped fixation-gearing-linking piece and adjacent the closed end portion of the "U"-shaped fixation-gearing-linking piece, wherein the first gearing piece of the gearing unit is rotatable with respect to the "U"-shaped fixation-gearing-linking piece.

16. The motorized bed frame of claim 15, further comprising:

one or more movable bars at the one or each of the first and second sides of the motorized bed frame, each of the one or more movable bars having a first end pivotally connected with a corresponding longitudinal bar in the first and second longitudinal bars, and a second end pivotally connected with the upper frame.

17. The motorized bed frame of claim 15, wherein the upper sub-frame at the one or each of the first and second sides of the motorized bed frame comprises two or more sub-frames pivotally connected to each other.

18. The motorized bed frame of claim 15, wherein at the one or each of the first and second sides of the motorized bed frame, the gearing unit further comprises a gearing-piece-linking bar disposed between two second gearing pieces and having two ends each fixedly connected with one of the two second gearing pieces.

19. The motorized bed frame of claim 18, wherein at the one or each of the first and second sides of the motorized bed frame, the corresponding first or second lateral bar comprises a lateral groove to accommodate at least a portion of the gearing-piece-linking bar when the upper sub-frame is laid on the lower frame.

* * * * *